United States Patent [19]

Mitani et al.

[11] 4,426,853

[45] Jan. 24, 1984

[54] AIR CONDITIONING SYSTEM

[75] Inventors: Akio Mitani, Yokohama; Koichi Matsui, Tokyo; Hirotsugu Sakata, Chigasaki, all of Japan

[73] Assignee: Tokyo Shibaura Denki Kabushiki Kaisha, Kawasaki, Japan

[21] Appl. No.: 341,065

[22] Filed: Jan. 20, 1982

[30] Foreign Application Priority Data

Jan. 26, 1981 [JP] Japan ..... 56-10058

[51] Int. Cl.[3] ..... F25B 27/00; F23L 15/02

[52] U.S. Cl. ..... 62/235.1; 165/8; 62/309

[58] Field of Search ..... 62/304, 309, 235.1; 126/428; 165/89, 66, 8

[56] References Cited

U.S. PATENT DOCUMENTS 4,203,298 5/1980 Glenn, Jr. et al. ..... 62/309

FOREIGN PATENT DOCUMENTS 52-47703 3/1977 Japan ..... 62/304

OTHER PUBLICATIONS

Taiyo Energy, no Kiso to Oyo, pp. 171–172, Omu Sya, 1978.

Solar Energy 21(4), p. 273, "Simulations of the Performance of Open Cycle Desiccant Systems Using Solar Energy", J. S. Nelson et al., 1978.

Solar System Kaitto, 2(6), p. 19, Shin Hoshiki Netsukudo-gata Kucho System no Tikken Tukatu, Tomura 1979.

*Primary Examiner*—William E. Wayner
*Assistant Examiner*—Henry Bennett
*Attorney, Agent, or Firm*—Oblon, Fisher, Spivak, McClelland & Maier

[57] ABSTRACT

An air conditioning system comprises a first air duct having an inlet port and an exhaust port opening into a room, a room air circulating fan for introducing the air inside the room into the first air duct through the inlet port and discharging the air into the room through the exhaust port of the first air duct, solar heat collector for producing hot air by utilizing solar heat, a second air duct adjacent to the first air duct on the inlet port side thereof, hot air feeding fan for feeding the hot air from the solar heat collector into the second air duct, a rotary total heat exchanger for dehumidification disposed between said first and second air ducts so as to extend severally in the two ducts, a third air duct adjacent to the first air duct on the downstream side of the rotary total heat exchanger, outside air feeding fan for feeding the outside air into the third air duct, a stationary multi-diaphragm-type sensible heat exchanger for cooling disposed between the first and third air ducts so as to be located in common inside said two air ducts.

7 Claims, 7 Drawing Figures

AIR CONDITIONING SYSTEM

BACKGROUND OF THE INVENTION

This invention relates to an air conditioning system provided with a heat exchanger for dehumidification and a heat exchanger for cooling, and employing an open-type dehumidification air-cooling cycle.

A prior art air conditioning system of this type is generally constructed as shown in FIG. 1. In FIG. 1, numeral 1 designates a room to be air-cooled. Air inside the room 1 is passed successively through a rotary heat exchanger 3 for dehumidification and a rotary heat exchanger 4 for cooling by means of a pipe 2, evaporation-cooled by a humidifier 5, and then returned to the room 1. On the other hand, the outside air is evaporation-cooled by a humidifier 6, and then led into the rotary heat exchanger 4. Thereafter, it is heated by a main heat source 7 and an auxiliary heat source 8, and then supplied to the rotary heat exchanger 3 and discharged into the outside space. In such a system, the air led from the room 1 is both dehumidified and heated as it passes through the rotary heat exchanger 3, and then is cooled as it passes through the rotary heat exchanger 4. Thereafter, it is further cooled by the humidifier 5 and returned to the room 1. Thus, the room 1 is cooled.

In the prior art system of the above-mentioned construction, both of the heat exchangers for dehumidification and for cooling are of a rotary type, which requires great driving power. Accordingly, the system requires considerable total power consumption, and is generally complicated and bulky due to the use of the two sections to be driven.

SUMMARY OF THE INVENTION

An object of this invention is to provide an air conditioning system capable of reduction in driving power consumption, as well as of compact general design and reduction in setting space.

Another object of the invention is to provide an air conditioning unit simplified in construction and improved in compactness.

An air conditioning system according to this invention comprises a first air duct for circulating air inside a room, a second air duct causing hot air from a solar heat collecting means to flow beside the first air duct, and a third air duct causing the outside air to flow beside the first air duct. Between the first and second air ducts is disposed a rotary total heat exchanger for heat-dehumidifying the room air flowing through the first air duct by means of the hot air flowing through the second air duct. Between the first and third air ducts is disposed a stationary multi-diaphragm-type sensible heat exchanger for cooling the heat-dehumidified room air flowing through the first air duct by means of the outside air flowing through the third air duct. Further, the first air duct is provided with a humidifier for humidification-cooling the cooled room air flowing through the first air duct.

Requiring no driving power, the multi-diaphragm-type sensible heat exchanger for cooling consumes less power than the rotary total heat exchanger does. Moreover, the combination of the multi-diaphragm-type sensible heat exchanger and the rotary total heat exchanger leads to improved compactness of the system as a whole, facilitating unit design and ensuring reduced setting space.

BRIEF DESCRIPTION OF THE DRAWINGS

FIGS. 3A and 3B show a rotary total heat exchanger, in which FIG. 3A is a general perspective view, and FIG. 3B is a partial front view;

FIGS. 5 and 6 show an air conditioning unit, in which FIG. 5 is an assembled perspective view, and FIG. 6 is a disassembled perspective view.

DETAILED DESCRIPTION OF THE PREFERRED EMBODIMENT

Now there will be described an air conditioning system according to an embodiment of this invention with reference to the accompanying drawings.

Figure 1:
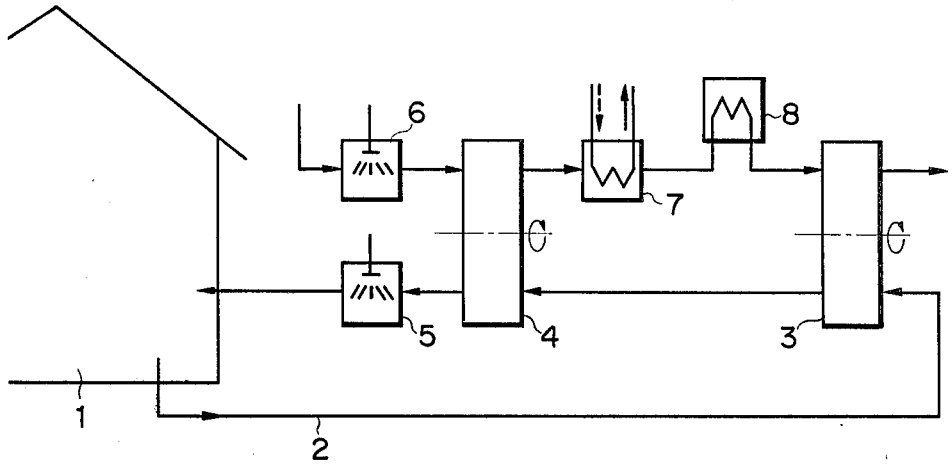
FIG. 1 (PRIOR ART)
FIG. 1 is a schematic view of a prior art air conditioning system.
Figure 2:
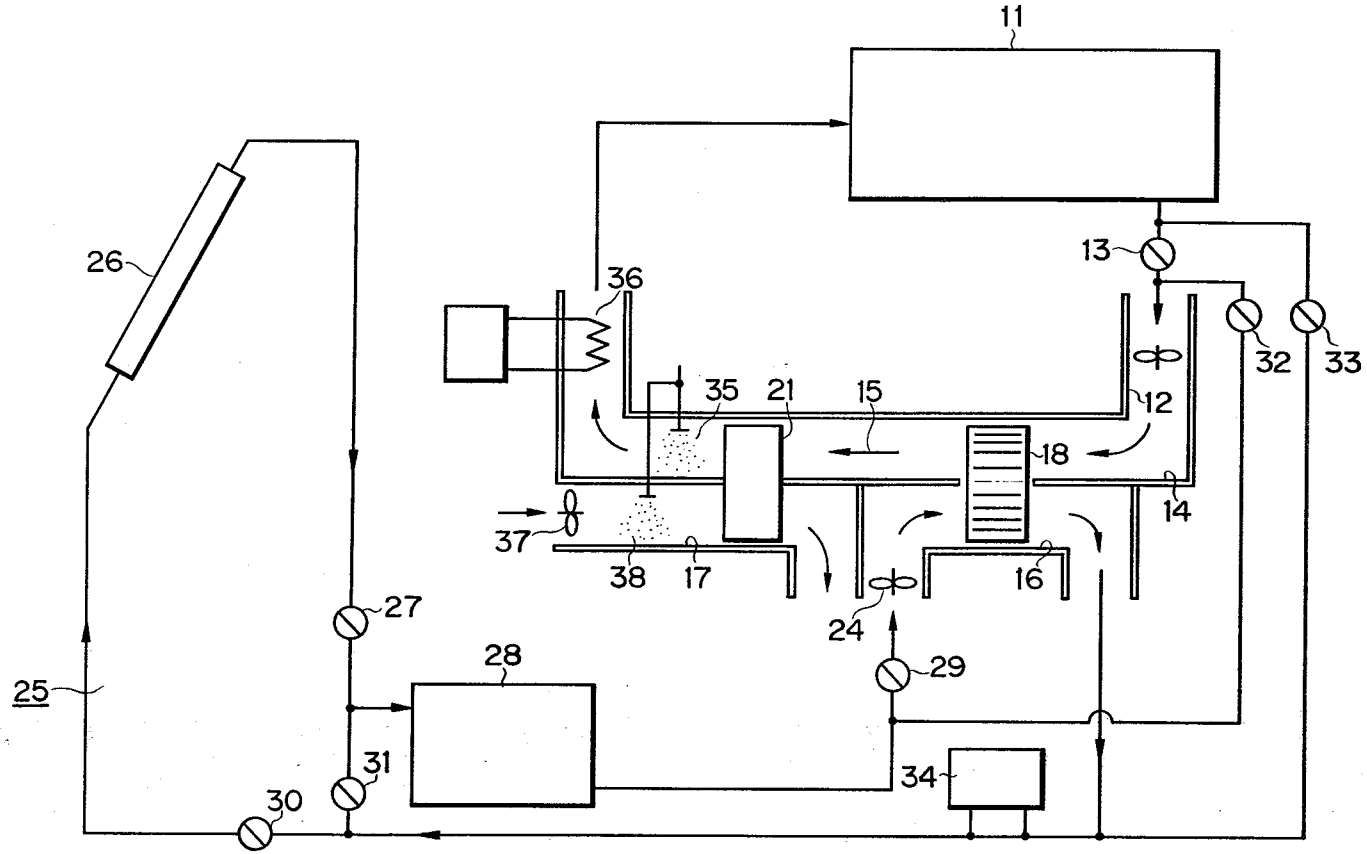
FIG. 2 is a schematic view of an air conditioning system according to an embodiment of this invention.

In FIG. 2 diagrammatically showing the air conditioning system, numeral 11 designates a room which requires air conditioning. The inlet port and exhaust port of a first air duct 14 open into the room 11. Air inside the room 11 is circulated as indicated by arrows 15; sucked in by a fan 12 and returned to the room 11 by way of a damper 13 and the air duct 14.

Second and third air ducts 16 and 17 are independently attached to the flank of the first air duct 14, arranged along the flow of air inside the first air duct 14. Inside the first air duct 14 and the second air duct 16 adjacent thereto and located on the upper-course side thereof or on the inlet port side, there is a rotary total heat exchanger 18 for dehumidification disposed so that its rotating shaft extends along the extending direction of the ducts, and that one and the other sides of the exchanger 18 with respect to the rotating shaft are located in the air ducts 14 and 16, respectively.

Figure 3A:
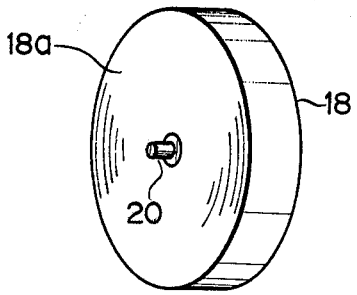
Figure 3B:
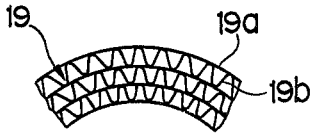

As shown in FIGS. 3A and 3B, the rotary total heat exchanger 18 is formed of two elongate special synthetic paper sheets 19*a* and 19*b* impregnated with hygroscopic substances such as a lithium chloride solution, activated charcoal, etc. The sheet 19*b* is corrugated longitudinally, and the two sheets 19*a* and 19*b* are rolled or curled in layers to form a multitude of axial pasages. A rotating shaft 20 is fixed in the center of a rotating body 18*a* formed of the roll member, with its ends projected on either side of the rotating body 18*a*. The rotating shaft 20 is so located as to extend between and along the first and second air ducts, and is rotatably supported by a bearing (not shown in FIG. 2). By rotating the shaft 20 by means of a driving mechanism such as a motor, air flowing through the spaces defined by the corrugated portion of the synthetic paper sheet on the first air duct side is exchanged for air on the second air duct side to cause heat exchange between the air flowing through the two ducts.

Figure 4:
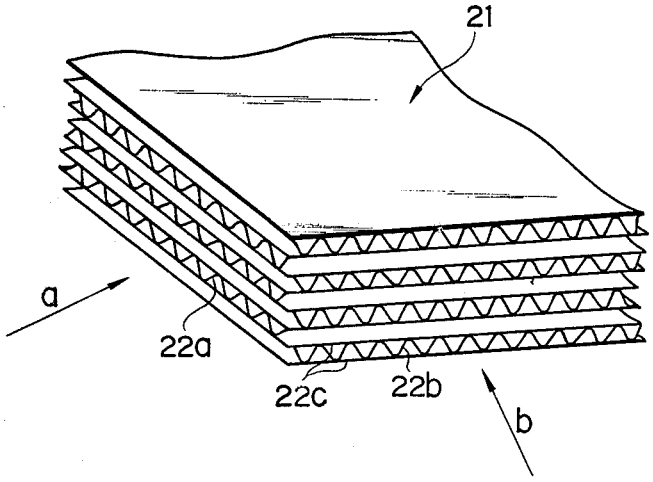
FIG. 4 is a perspective view showing part of a stationary multi-diaphragm-type sensible heat exchanger.

A stationary multi-diaphragm-type sensible heat exchanger 21 for humidification-cooling is disposed between the first and third air ducts 14 and 17 so that part of the heat exchanger 21 is located in each duct. As shown in FIG. 4, the heat exchanger 21 is formed of a multitude of sets of three heat-conductive sheets 22*a*, 22*b* and 22*c* in layers made of a good conductor of heat such as paper, plastics, asbestos or metal. The first and second conductive sheets 22*a* and 22*b* are corrugated, while the third conductive sheet 22*c* is flat. The second, third and first conductive sheets 22*b*, 22*c* and 22*a* are successively laid on and over the third conductive sheet 22*c* so that the directions of corrugation of the second and first sheets 22*b* and 22*a* intersect each other at right angles. A multitude of such assemblies are stacked in layers. Thus, air introduced into the heat exchanger 21 in the direction of an arrow a and flowing through first passages defined between the first and third conductive sheets 22*a* and 22*c* exchanges heat with air introduced into the heat exchanger 21 in the direction of an arrow b substantially at right angles to the direction of the arrow a and flowing through second passages defined between the second and third conductive sheets 22*b* and 22*c*.

Disposed in the second air duct 16 is a blower or fan 24 whereby hot air produced by a solar heat collecting hot-air heater 25 is circulated through the air duct 16, as shown in FIG. 2. The hot-air heater 25 is of what is called a closed-loop type. Air heated in a heat collector 26 by solar heat is led into the second air duct 16 through a damper 27, a regenerative tank 28, and a damper 29. The air cooled by the heat exchanger 18 is returned to the heat collector 26 through a damper 30. Such circulation of air is performed by means of the fan 24 and a duct connecting those members. In the embodiment shown in FIG. 2, there are provided dampers 31, 32 and 33 and ducts accompanying the same for heating. Numeral 34 designates a dehumidifier.

A spray-type humidifier 35 is disposed in a position on the downstream side of the diaphragm-type sensible heat exchanger 21 inside the first air duct 14, that is, between the stationary heat exchanger 21 and the exhaust port of the duct 14. Further, a conventional auxiliary heat source 36 using electricity, gas or petroleum is disposed in a position on the downstream side of the humidifier 35, whereby air passed through the humidifier 35 can be heated as required.

Disposed at the inlet of the third air duct 17 is a blower or fan 37 whereby the outside air is sucked in through the air duct 17. A spray-type humidifier 38 is disposed between the fan 37 and the stationary heat exchanger 21.

Now there will be described the operation of the air conditioning system of the above-mentioned construction.

In the air-cooling operation, the fans 12, 24 and 37 are driven, the dampers 13, 27, 29 and 30 are opened, the dampers 31, 32 and 33 are closed, and the rotary total heat exchanger 18 and the humidifiers 35 and 38 are driven. By the start of the fan 12, the air inside the room 11 is caused to flow through the air duct 14 in the direction of the arrows 15, and then returned to the room 11. As the air from the room 11 flows through the air duct 14, it passes through the rotary total heat exchanger 18, and water contained in the air is adsorbed on and removed by the special synthetic paper sheets 19*a* and 19*b*. Since the high-temperature air provided by the solar heat collector 25 is then flowing through the third air duct 16, the water adsorbed on the rotary total heat exchanger 18 is brought into contact with the high-temperature air to be evaporated, and is finally removed by the dehumidifier 34. Accordingly, the rotary total heat exchanger 18 is regenerated with every revolution of its special synthetic paper sheets. The air inside the duct 14 thus heated by the heat exchanger 18 is fed into the stationary multi-diaphragm-type sensible heat exchanger 21 and passes through the first passages thereof. Through the second passages of the heat exchanger 21 flows the outside air evaporation-cooled by the humidifier 18. Thus, the room air flowing through the first passages is cooled by the cooled outside air. The cooled air is evaporation-cooled by the humidifier 35, and then returned to the room 11. As a result, the room 11 is cooled.

There has been described the case of air-cooling operation under the conditions in which the heat collector 26 can operate. In the night air-cooling operation, however, heat previously accumulated in the regenerative tank 28 can be utilized with the dampers 27 and 30 closed and the damper 31 open. In the heating operation, on the other hand, the air inside the room 11 is circulated through a course extending from the room 11 to the air duct 14 via the damper 33, damper 30, heat collector 26, damper 27, regenerative tank 28 and the damper 32, and returning to the room 11, or a course extending from the room 11 to the air duct 14 via the damper 33, damper 31, regenerative tank 28 and the damper 32, and returning to the room 11. In this case, the fans 24 and 37 and the rotary total heat exchanger 18 are stopped, and only the humidifier 35 need be operated.

Figure 5:
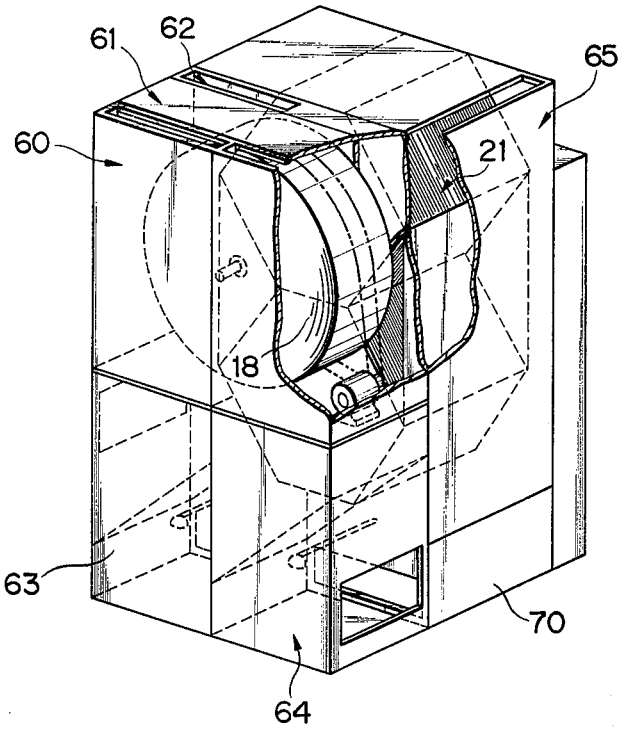
Figure 6:
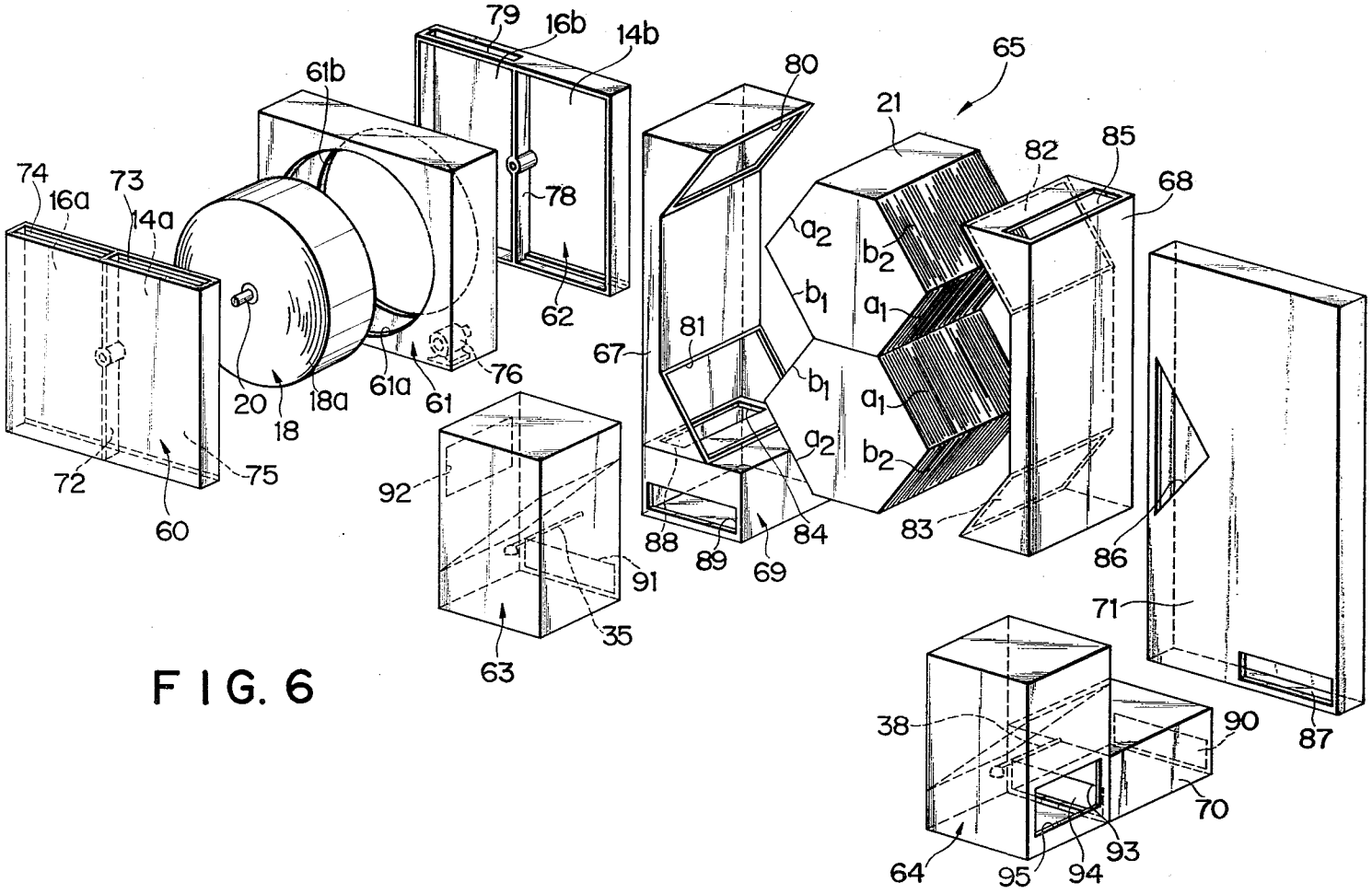

Referring now to FIGS. 5 and 6, there will be described a unit incorporating the rotary total heat exchanger 18, the stationary multi-diaphragm-type sensible heat exchanger 21, parts of the air ducts 14, 16 and 17, and the humidifiers 35 and 38 of the air conditioning system shown in FIG. 2.

Generally, this unit is in the form of a substantially rectangular box, as shown in FIG. 5. As shown in FIG. 6, the unit includes first, second and third flat boxes 60, 61 and 62 arranged horizontally in line with one another, fourth and fifth cubic boxes 63 and 64 disposed under the first to third boxes, and a sixth box 65 adjoining these boxes. The sixth box 65 may be divided into a pair of lateral sections 67 and 68, a pair of bottom sections 69 and 70, and a back section 71.

The first box 60 is divided right and left by an intermediate wall 72 into two parts; an air inlet chamber 16*a* of the second air duct 16 defined on one side and an air inlet chamber 14*a* of the first air duct 14 on the other. Inlet ports 73 and 74 of the inlet chambers 14*a* and 16*a* are defined in the top wall of the first box 60, and an exhaust port 75 is defined substantially all over the surface of the rear wall. A horizontal bore to serve as a bearing is bored through the central portion of the intermediate wall 72.

The second box 61 is substantially entirely hollow, and has circular openings 61*a* and 61*b* defined substantially in the central portions of the front and rear walls thereof, respectively. In the hollow space inside the box 61 is contained the rotary total heat exchanger 18 with substantially the same diameter as those of the circular openings 61*a* and 61*b* and coaxial therewith. In the hollow space, moreover, is fixed an electric motor 76, whereby the total heat exchanger 18 can be rotated by means of a belt stretched between the shaft of the motor 76 and the outer circumference of the exchanger 18, for example.

The third box 62 is divided right and left by an intermediate wall 78 into two parts; an air outlet chamber 16*b* of the second air duct 16 defined on one side and an intermediate chamber 14*b* of the first air duct 14 on the other. An exhaust port 79 of the air outlet chamber 16*b* is defined in the top wall of the box 62, the front of which is opened substantially entirely. Accordingly, when the first and third boxes 60 and 62 are so coupled as to face each other with the second box 61 between them, the inlet chambers 16*a* and 14*a* of the second and first air ducts 16 and 14 are caused to communicate with the outlet chamber 16*b* and the intermediate chamber 14*b*, respectively, by means of the rotary total heat exchanger 18.

The rear wall of the third box 62 is opened behind the intermediate chamber 14*b* to communicate with the box 65 in the next stage. Both the lateral sections 67 and 68 of the box 65 have substantially the same shape and are hollow, with their inner side faces inclined at the upper and lower portions. Openings 80 to 83 are formed severally at the upper and lower inclined portions of the inner side faces of the lateral sections 67 and 68. An opening 84 is formed in the bottom wall of the one lateral section 67, while an opening 85 is formed in the top wall of the other lateral section 68. The back section 71 is hollow and flat, having a triangular opening 86 and a rectangular opening 87 formed in the central left portion and lower right portion of its front wall, respectively. The bottom section 69 is in contact with the under surface of the lateral section 67, having an opening 88 formed in its top wall in alignment with the opening 84, whereby the bottom section 69 is allowed to communicate with the lateral section 67. An opening 89 is formed in the front of the bottom section 69. The other bottom section 70, which is in contact with the under surface of the lateral section 68, is not allowed to communicate directly with the lateral section 68. An opening 90 is formed in the back of the bottom section 70 in alignment with the opening 87 in the back section 71, whereby the bottom section 70 is allowed to communicate with the back section 71. Thus, a chamber to contain the stationary multi-diaphragm-type sensible heat exchanger 21 is defined between the inner sides of the two lateral sections 67 and 68, the front of the back section 71, and the back of the third box 62.

The fourth and fifth boxes 63 and 64 have substantially the same shape, and are so located as to be in contact with the under surfaces of the first to third boxes 60, 61 and 62 and the front of the sixth box 65 in common. An opening 91 is formed in the rear wall of the fourth box 63 in alignment with the opening 89 of the bottom section 69, whereby the box 63 is allowed to communicate with the bottom section 69. Further, an exhaust port 92 is formed in the outer side wall of the box 63. The cooling humidifier 35 is contained in the box 63 so that air flowing through the box 63 may be humidification-cooled. An opening 94 is formed in the rear wall of the fifth box 64 in alignment with the opening 93 in the front wall of the bottom section 70, whereby the box 64 is allowed to communicate with the bottom section 70. Further, an inlet port 95 is formed in the outer side wall of the box 64. The cooling humidifier 38 is contained in the fifth box 64 so that air flowing through the box 64 may be humidification-cooled.

The basic structure of the stationary multi-diaphragm-type sensible heat exchanger 21 is the same as the one shown in FIG. 4. The general configuration of the exchanger 21 is as shown in FIG. 6. Each conductive sheet of the heat exchanger 21 is in the shape of two substantially regular hexagons coupled on one side. In the heat exchanger 21 formed of a multitude of such conductive sheets in layers, a pair of end faces $a_1$ on the room air inlet side and a pair of end faces $b_2$ on the outside air outlet side are defined on one side, and a pair of end faces $a_2$ on the room air outlet side and a pair of end faces $b_1$ on the outside air inlet side are defined on the other side.

In the unit of the above-mentioned construction, the room air is introduced through the inlet port 73 of the first box 60, and led into the sixth box 65 through the rotary total heat exchanger 18 and the third box 62. Thereupon, the air enters the stationary multi-diaphragm-type sensible heat exchanger 21 from the side of the end faces $a_1$ and comes out from the side of the end faces $a_2$, and then enters the left-hand lateral section 67 through the openings 80 and 81. Thereafter, the air is led into the fourth box 63 through the left-hand bottom section 69, and then returned to the room via the exhaust port 92.

The air heated by the solar heat collecting hot-air heater is led into the first box 60 through the inlet port 74, introduced into the third box 62 through the rotary total heat exchanger 18, and led out through the exhuast port 79 formed in the exchanger 18.

The outside air is introduced into the fifth box 64 through the inlet port 95, and then into the back section 71 by way of the right-hand bottom section 70 and the lower opening 87, and thereafter led out through the middle opening 86 into the sixth box 65. Thereupon, the air enters the stationary multi-diaphragm-type sensible heat exchanger 21 from the side of the end faces $b_1$ and comes out from the side of the end faces $b_2$, and then enters the right-hand lateral section 68 through the openings 82 and 83. Finally, the air is discharged into the outside space through the exhaust port 85 formed in the right-hand lateral section 68.

Although the functions of the rotary total heat exchanger 18, the stationary multi-diaphragm-type sensible heat exchanger 21, and the cooling humidifiers 35 and 38 of the above-mentioned unit have not been described herein, they are substantially the same as those of the corresponding members described with reference to FIG. 2.

The stationary multi-diaphragm-type sensible heat exchanger may be so constructed that the directions of air flows are opposite to each other, instead of intersected at right angles.

What we claim is:

1. An air conditioning system for conditioning air inside a room, said air conditioning system comprising:

(a) a first air duct having:
  (i) an inlet port opening into said first air duct from the room and
  (ii) an exhaust port opening into the room from said first air duct;

(b) a room air circulating mechanism:
  (i) for introducing the air inside the room into said first air duct through said inlet port and
  (ii) for discharging the air inside said first air duct into the room through said outlet port;

(c) solar heat collecting means for producing hot air by utilizing solar heat;

(d) a second air duct having a bordering portion adjacent to said first air duct on the inlet port side thereof;

(e) hot air feeding means for feeding the hot air from said solar heat collecting means into said second air duct;

(f) a rotary total heat exchanger for dehumidification disposed between said first air duct and the bordering portion of said second air duct so as to extend into and communicate with both of said ducts, said rotary total heat exchanger being rotated so as to cause air flowing through said first air duct to exchange heat with air flowing through said second air duct;

(g) a third air duct having:

(i) a bordering portion adjacent to said first air duct on the downstream side of the rotary total heat exchanger;

(ii) an inlet port opening into said third air duct from the outside; and (iii) an exhaust port to the outside from said third air duct;

(h) outside air feeding means:

(i) for feeding the outside air into said third air duct through said inlet port and (ii) for discharging the air inside said third air duct to the outside through said outlet port;

(i) a stationary multi-diaphragm-type sensible heat exchanger for cooling disposed between said air duct and the bordering portion of said third air duct so as to extend into and communicate with both of said ducts so as to cause air flowing through said first air duct to exchange heat with air flowing through said third air duct; and (j) a humidifier disposed inside said first air duct between said exhaust port of said first air duct and said stationary multi-diaphragm-type sensible heat exchanger so as to evaporation-cool air passing therethrough.

2. An air conditioning system according to claim 1 wherein:

(a) the bordering portion of said second air duct extends in parallel with said first air duct and (b) said rotary total heat exchanger includes:

(i) a rotating shaft located between the bordering portion of said second air duct and said first air duct and extending in parallel to the bordering portion of said second air duct and said first air duct and (ii) a rotating body mounted on said rotating shaft for rotation therewith, said rotating body being symmetrical with respect to said rotating shaft and having a multitude of axial passages therein.

3. An air conditioning system according to claim 1 or claim 2 wherein:

(a) said stationary multi-diaphragm-type sensible heat exchanger includes a multitude of heat-conductive sheets stacked so that passages are defined between each two adjacent ones among said conductive sheets;

(b) said passages include first passages located in said first air duct and second passages located in said third air duct; and (c) said first and second passages adjoin one another with said heat-conductive sheets therebetween.

4. An air conditioning system according to claim 1 wherein:

(a) said solar heat collecting means comprises a solar heat collecting hot-air heater having an inlet and an outlet and (b) said hot air feeding means comprises:

(i) an input duct connecting said inlet to the downstream end of said second air duct and (ii) an output duct connecting said outlet to the upstream end of said second air duct.

5. An air conditioning system according to claim 4 wherein said hot air feeding means further comprises:

(a) a regenerative tank disposed in said output duct and (b) damper means disposed in said output duct for selectively causing said regenerative tank and said solar heat collecting hot-air heater to communicate with the upstream end of said second air duct.

6. An air conditioning unit comprising:

(a) a housing;

(b) a rotary total heat exchanger rotatably contained in said housing;

(c) a stationary multi-diagragm-type sensible heat exchanger contained in said housing;

(d) a first air duct formed in said housing and having an inlet port and an exhaust port, said first air duct being arranged such that air introduced through said inlet port is led to said exhaust port by way of said rotary total heat exchanger and said stationary multi-diaphragm-type sensible heat exchanger;

(e) a second air duct formed in said housing and having an inlet port and an exhaust port, said second air duct being arranged such that:

(i) air introduced through said inlet port is led to said exhaust port be way of said rotary total heat exchanger and (ii) air passes through said first and second air duct in said rotary total heat exchanger in counter-current and heat-exchange relationship; and (f) a third air duct formed in said housing and having an inlet port and an exhaust port, said third air duct being arranged such that:

(i) air introduced through said inlet port is led to said exhaust port by way of said stationary multi-diaphragm-type sensible heat exchanger and (ii) air passes through said first and third air ducts in said stationary multi-diaphragm-type sensible heat exchanger in counter-current and heat-exchange relationship.

7. An air conditioning unit according to claim 6 wherein:

(a) said housing is a substantially rectangular main box;

(b) the inlet port and exhaust port of said first air duct are formed in first and second faces of said substantially rectangular main box, respectively;

(c) the inlet port and exhaust port of said second air duct are formed in said first face;

(d) the inlet port of said third air duct is formed in a third face of said substantially rectangular main box, said third face being opposite to said second face; and (e) the exhaust port of said third air duct is formed in said second face.

* * * * *